US010458718B2

(12) United States Patent
Shen et al.

(10) Patent No.: US 10,458,718 B2
(45) Date of Patent: Oct. 29, 2019

(54) AIRTIGHT PENETRATION STRUCTURE FOR HEAT DISSIPATION DEVICE

(71) Applicant: ASIA VITAL COMPONENTS CO., LTD., New Taipei (TW)

(72) Inventors: Ching-Hang Shen, New Taipei (TW); Fu-Kuei Chang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 15/826,603

(22) Filed: Nov. 29, 2017

(65) Prior Publication Data

US 2019/0162480 A1 May 30, 2019

(51) Int. Cl.

| | |
|---|---|
| ***F28D 15/02*** | (2006.01) |
| ***F28F 3/08*** | (2006.01) |
| ***F28D 15/04*** | (2006.01) |

(52) U.S. Cl.

CPC ..... *F28D 15/0283* (2013.01); *F28D 15/0275* (2013.01); *F28D 15/046* (2013.01); *F28F 3/08* (2013.01); *F28F 2245/02* (2013.01)

(58) Field of Classification Search

CPC ..... F28D 15/0283; F28D 15/0275; F28D 15/046; F28F 3/08; F28F 2245/02; F28F 21/08; F28F 21/084; F28F 21/085; F28F 21/086

See application file for complete search history.

(56) References Cited

U.S. PATENT DOCUMENTS

| | | | | |
|---|---|---|---|---|
| 4,461,343 | A * | 7/1984 | Token | F28D 15/0233 165/104.26 |
| 4,638,854 | A * | 1/1987 | Noren | F28D 15/04 165/182 |
| 5,317,805 | A * | 6/1994 | Hoopman | B23P 15/26 257/E23.098 |
| 5,513,070 | A * | 4/1996 | Xie | G06F 1/203 165/185 |
| 6,082,443 | A * | 7/2000 | Yamamoto | F28D 15/0233 165/104.21 |
| 6,263,959 | B1 * | 7/2001 | Ikeda | F28D 15/0233 165/104.26 |
| 6,302,192 | B1 * | 10/2001 | Dussinger | F28D 15/0233 165/104.21 |
| 6,535,386 | B2 * | 3/2003 | Sathe | H01L 23/4006 165/104.33 |

(Continued)

*Primary Examiner* — Travis C Ruby

(74) *Attorney, Agent, or Firm* — Jackson IPG PLLC; Demian K. Jackson

(57) ABSTRACT

An airtight penetration structure for heat dissipation device includes a first plate member, a second plate member, and a plurality of hollow shaft members. The first and the second plate member are closed to each other to together define a closed chamber between them. The hollow shaft members are respectively provided at two free ends with a first and a second flange. The hollow shaft members are correspondingly extended through fastening holes provided on the first and the second plate member with the first and the second flanges attached to and flush with outer surfaces of the first and the second plate member to seal around the fastening holes, so that the closed chamber between the first and the second plate member is in an airtight state.

21 Claims, 8 Drawing Sheets

(56) References Cited

U.S. PATENT DOCUMENTS 6,650,544 B1 * 11/2003 Lai ..... F28D 15/046 165/104.21
6,802,363 B1 * 10/2004 Wang ..... F28D 15/0233 165/104.21
6,874,568 B2 * 4/2005 Lai ..... F28D 15/0233 165/104.26
6,896,039 B2 * 5/2005 Dussinger ..... B22F 3/11 165/104.21
7,032,652 B2 * 4/2006 Wang ..... F28D 15/0233 165/104.26
7,100,679 B2 * 9/2006 Dussinger ..... F28D 15/0233 165/104.21
7,246,655 B2 * 7/2007 Mochizuki ..... F28D 15/046 165/104.21
7,599,185 B2 * 10/2009 Meyer, IV ..... H01L 23/427 165/104.21
8,792,238 B2 * 7/2014 Meyer, IV ..... F28D 15/0275 165/104.21
8,875,779 B2 * 11/2014 Lien ..... F28D 15/04 165/104.26
8,985,196 B2 * 3/2015 Yang ..... F28D 15/0233 165/104.26
8,985,197 B2 * 3/2015 Wang ..... F28D 15/0233 165/104.21
9,700,930 B2 * 7/2017 Yang ..... B21D 53/02
9,851,155 B2 * 12/2017 Slayzak ..... F28F 19/00
2002/0030972 A1 * 3/2002 Ali ..... H01L 23/4006 361/704
2002/0067598 A1 * 6/2002 Sathe ..... H01L 23/4006 361/700
2003/0155105 A1 * 8/2003 Garner ..... F28D 15/0233 165/104.26
2003/0159806 A1 * 8/2003 Sehmbey ..... F28D 15/0233 165/80.3
2004/0016534 A1 * 1/2004 Lai ..... F28D 15/0233 165/104.26
2004/0199039 A1 * 10/2004 Brophy ..... B01F 5/0475 585/660
2005/0051307 A1 * 3/2005 Dussinger ..... F28D 15/0233 165/104.26
2005/0269065 A1 * 12/2005 Chen ..... B82Y 10/00 165/104.26
2006/0005951 A1 * 1/2006 Yeh ..... F28D 15/046 165/104.26
2006/0096740 A1 * 5/2006 Zheng ..... F28D 15/0233 165/104.26
2006/0151153 A1 * 7/2006 Chen ..... F28D 15/02 165/104.26
2009/0056917 A1 * 3/2009 Majumdar ..... F28D 15/0233 165/104.26
2010/0077614 A1 * 4/2010 Hou ..... B22F 7/004 29/890.032
2010/0181048 A1 * 7/2010 Hwang ..... F28D 15/0233 165/104.26
2010/0294475 A1 * 11/2010 Rush ..... B22F 3/1121 165/185
2012/0227936 A1 * 9/2012 Yang ..... B05D 5/04 165/104.26
2013/0126133 A1 * 5/2013 Wu ..... F28D 15/0233 165/104.26
2014/0138057 A1 * 5/2014 Horng ..... F28D 15/0233 165/104.26
2014/0338870 A1 * 11/2014 Hiwatashi ..... F28F 3/10 165/166
2015/0201529 A1 * 7/2015 Wicks ..... H01L 23/4006 165/80.3
2015/0289413 A1 * 10/2015 Rush ..... H05K 7/20672 361/700
2016/0290739 A1 * 10/2016 Mochizuki ..... F28F 21/083
2017/0013747 A1 * 1/2017 Agostini ..... B23P 15/26
2018/0274866 A1 * 9/2018 Zhao ..... F28D 15/0275

* cited by examiner

AIRTIGHT PENETRATION STRUCTURE FOR HEAT DISSIPATION DEVICE

FIELD OF THE INVENTION

The present invention relates to an airtight penetration structure for heat dissipation device, and more particularly, to an airtight penetration structure that includes a plurality of hollow shaft members having flanges provided at two free ends thereof. The hollow shaft members are correspondingly extended through fastening holes formed on a heat dissipation device with the flanges attached to and flush with outer surfaces of the heat dissipation device to seal around the fastening holes, so that a chamber defined in the heat dissipation device is in an airtight state.

BACKGROUND OF THE INVENTION

The currently available electronic apparatus all have an enhanced performance. However, the electronic elements in the electronic apparatus for signal processing and data computing also produce more heat than before. The most frequently used heat dissipation devices include heat pipes, heat sinks, vapor chambers and the like. These heat dissipation devices are so arranged that they are in direct contact with the heat-producing electronic elements to ensure further enhanced heat dissipation effect and prevent the electronic elements from being burnt out due to overly high temperature thereof.

The vapor chamber is a device that enables heat transfer between two large surfaces to achieve the purpose of quick heat dissipation. Unlike the heat pipe that achieves heat dissipation via point-to-point heat transfer, the vapor chamber is more suitable for use in an electronic device having a relatively small internal space.

Conventionally, the vapor chamber is associated with a base board for use, so that heat produced by the heat-producing elements on the base board is transferred to the vapor chamber for quick dissipation into ambient air. To mount the vapor chamber to the base board according to a conventional way, at least one hole is formed on the vapor chamber at a position not interfering with the hollow portion of the vapor chamber. For example, a through hole is formed at each of four corners of the vapor chamber outside the closed inner space of the vapor chamber, and an internally threaded hollow copper shaft is inserted in each of the through holes. The base board is also provided with fastening holes at positions corresponding to the hollow copper shafts on the vapor chamber. Then, externally threaded fastening elements are correspondingly screwed into the internally threaded hollow copper shafts and the fastening holes to fixedly mount the vapor chamber on the base board. The above conventional mounting manner has a disadvantage. That is, the hollow copper shafts are located at four corners of the vapor chamber that are somewhat distant from the heat-producing element. In this case, the vapor chamber mounted on the base board could not be closely attached to the heat-producing element and thermal resistance tends to occur between the vapor chamber and the heat-producing element. To overcome the above problem, it has been tried to provide the hollow copper shafts on the vapor chamber at positions closer to the heat-producing element. In this case, the hollow copper shafts are directly extended through the closed inner space of the vapor chamber. While the above improved mounting manner can ensure the close attachment of the vapor chamber to the heat-producing element and avoid the occurrence of thermal resistance, the hollow copper shafts penetrating the closed inner space of the vapor chamber would endanger the air-tightness of the vapor chamber, rendering the vapor chamber no longer in a vacuum state. Further, with the hollow copper shafts penetrating the closed inner space of the vapor chamber, it is possible the flow path of the working fluid in the vapor chamber is hindered by the hollow copper shafts to cause lowered heat transfer efficiency. In a worse state, the penetrating hollow copper shafts might cause leakage of the working fluid and accordingly, failure of the vapor chamber in its heat transfer effect.

Please refer to FIGS. 1 and 2. disclose a heat spreader structure 5 including a main body 51 having a first flat plate 511 and a second flat plate 512. The first and the second flat plate 511, 512 are two separate members but connected to each other along peripheral lips 513 formed around them, so that the main body 51 internally defines a sealed chamber 514. Depressions 5111 are formed on the first flat plate 511 at locations far away from the peripheral lips 513 with their flat bottoms in contact with the second flat plate 512. Through holes 52 penetrate some of the depressions 5111 on the first flat plate 511 and penetrate the second flat plate 512. The depressions 5111 penetrated by the through holes 52 respectively have a round wall surface 5112. The round wall surfaces 5112 are correspondingly connected to annular areas 5121 on the second flat plate 512, such that the through holes 52 are isolated from the main body 51. Spacing pillars 53 are extended between and in contact with the first and the second flat plate 511, 512. And, a wick structure 54 is provided in the sealed chamber 514. In the above heat spreader structure 5, while the depressions 5111 can serve as a supporting structure and the connection of the through holes 52 to the annular areas 5121 provides an airtight effect, the depressions 5111 inevitably largely reduce the space in the sealed chamber 514 of the heat spreader structure 5 for gas-liquid circulation. The provision of the depressions 5111 also reduces the contact areas between the heat spreader structure 5 and the heat source, which results in lowered heat transfer efficiency. Further, it is uncertain whether or not the through holes 52 are exactly airtight.

Therefore, the conventional penetration structures for heat dissipation devices have the following disadvantages: (1) having the problem of thermal resistance; (2) reducing the heat transfer areas of the heat dissipation devices; and (3) lowering the heat transfer efficiency of the heat dissipation devices.

SUMMARY OF THE INVENTION

A primary object of the present invention is to provide an improved airtight penetration structure for heat dissipation device to overcome the disadvantages in the prior art penetration structures for heat dissipation devices, lest the vacuum-tight chambers of the heat dissipation devices should leak via the penetration structures.

To achieve the above and other objects, the airtight penetration structure for heat dissipation device according to an embodiment of the present invention includes a first plate member, a second plate member, and a plurality of hollow shaft members. The first plate member has a first side and a second side, and is provided with a plurality of first fastening holes. The first fastening holes respectively extend from the first side to the second side to penetrate the first plate member. The second plate member has a third side and a fourth side, and is provided with a plurality of second fastening holes. The second fastening holes respectively extend from the third side to the fourth side to penetrate the second plate member. The first and the second plate member are closed to each other with the first side facing toward the third side, such that a closed chamber is defined between them. The hollow shaft members are respectively provided at two free ends with a first flange and a second flange. The hollow shaft members are correspondingly extended through the first and the second fastening holes with the first and the second flanges attached to and flush with the second side of the first plate member and the fourth side of the second plate member, respectively, to seal around the first and the second fastening holes.

To achieve the above and other objects, the airtight penetration structure for heat dissipation device according to another embodiment of the present invention includes a first plate member and a second plate member. The first plate member has a first side and a second side, and is provided with a plurality of first fastening holes. The first fastening holes respectively extend from the first side to the second side to penetrate the first plate member. The second plate member has a third side and a fourth side and a plurality of hollow shaft members integrally formed thereon. The first and the second plate member are closed to each other with the first side facing toward the third side, such that a closed chamber is defined between them. The hollow shaft members respectively extend from the third side toward the first plate member to correspondingly extend through the first fastening holes on the first plate member. An end of each of the hollow shaft members extended through the first fastening hole is a free end, around which a first flange is provided. The first flange is attached to and is flush with the second side of the first plate member to seal around the first fastening holes.

With the airtight penetration structure of the present invention, it is able to ensure the air-tightness of the closed chamber defined in the heat dissipation device when the device is penetrated by the hollow shaft members of the airtight penetration structure.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
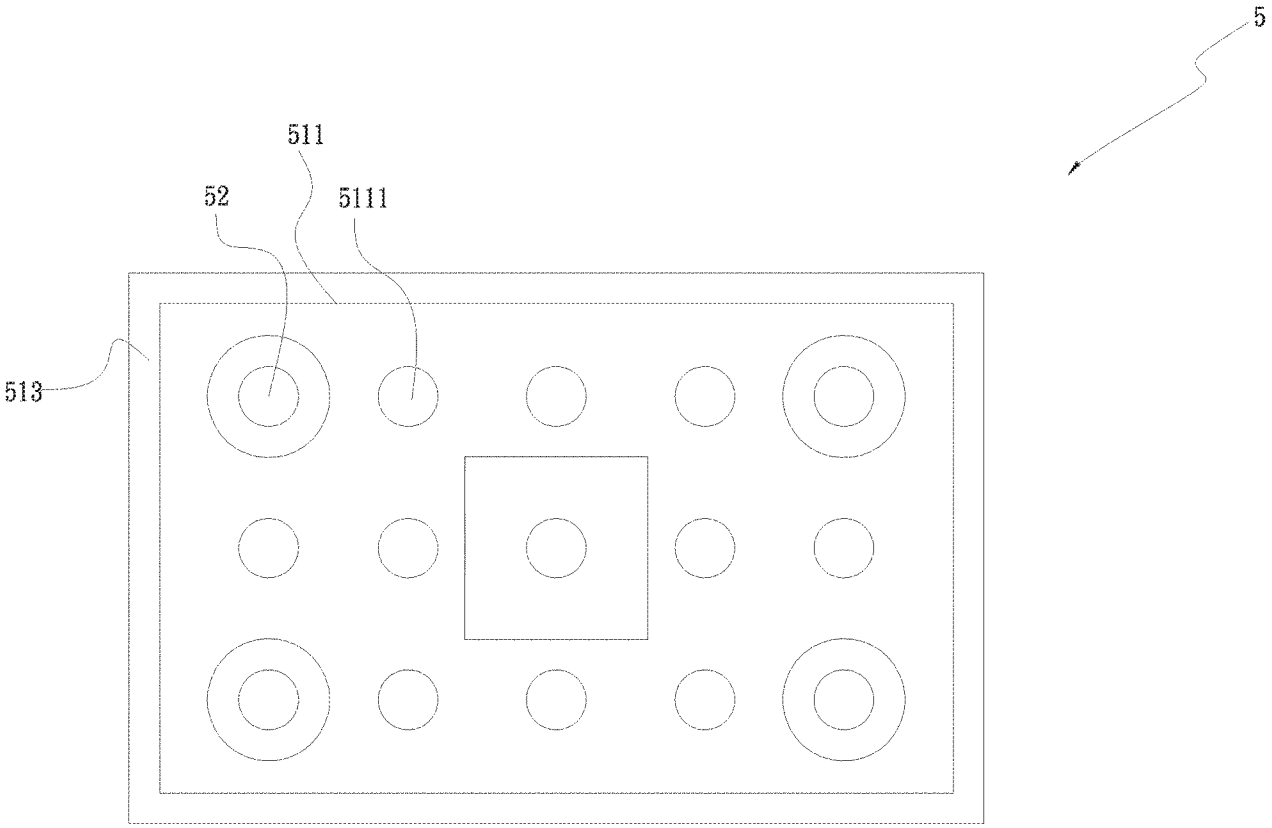
Fig. 1 (PRIOR ART)
FIG. 1 is a top view of a prior art heat dissipation device.
Figure 2:
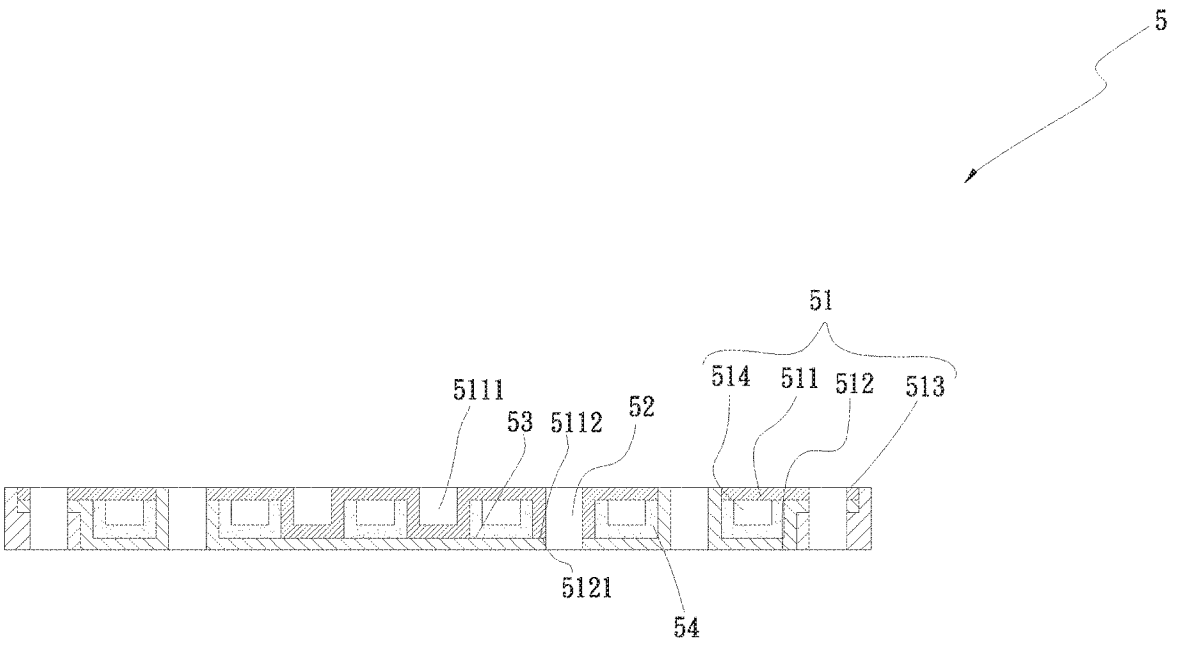
Fig. 2(PRIOR ART)
FIG. 2 is an assembled sectional view of the prior art heat dissipation device of FIG. 1.

The present invention will now be described with some preferred embodiments thereof and by referring to the accompanying drawings. For the purpose of easy to understand, elements that are the same in the preferred embodiments are denoted by the same reference numerals.

Figure 3:
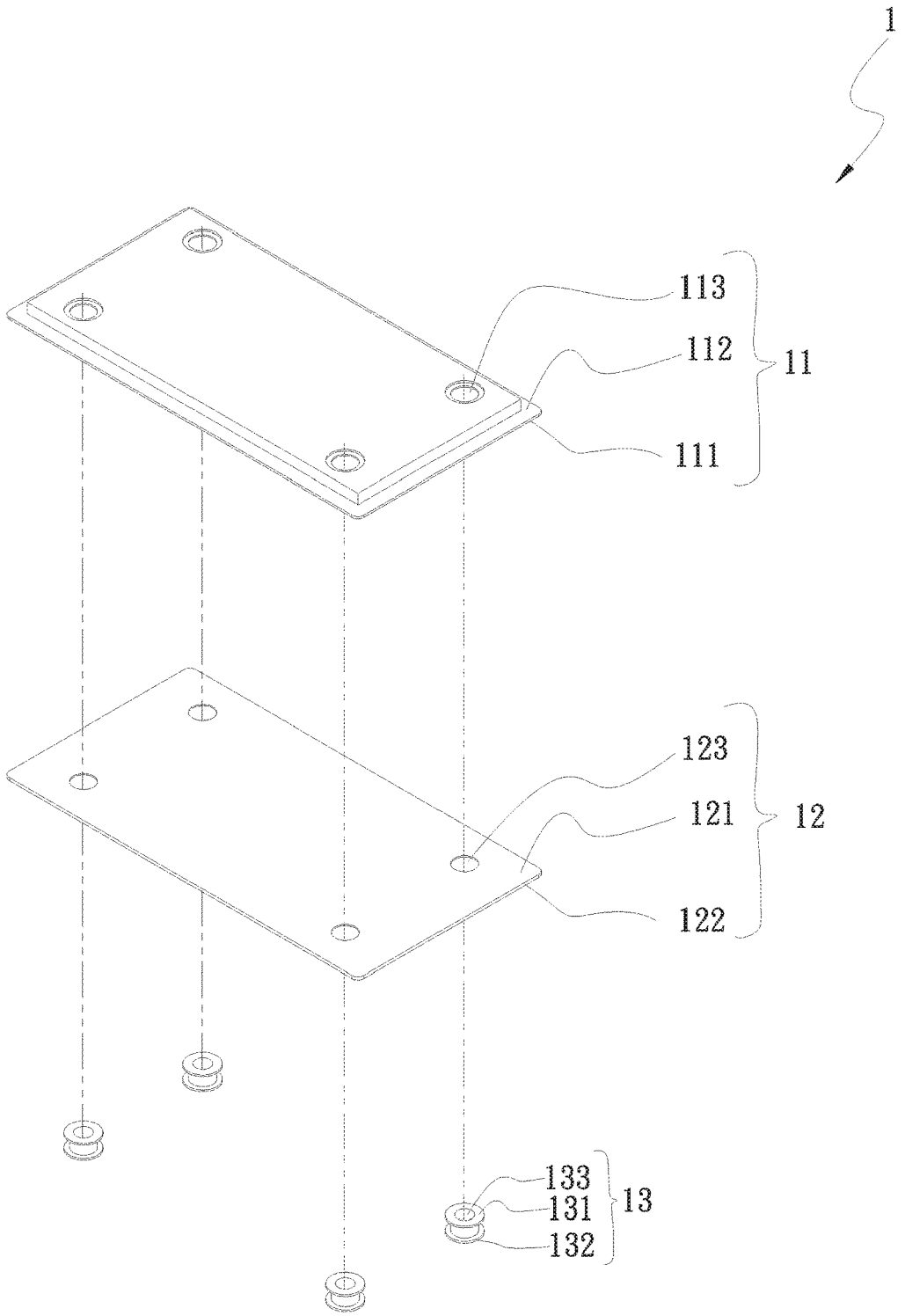
FIG. 3 is an exploded perspective view of an airtight penetration structure for heat dissipation device according to a first embodiment of the present invention.
Figure 4:
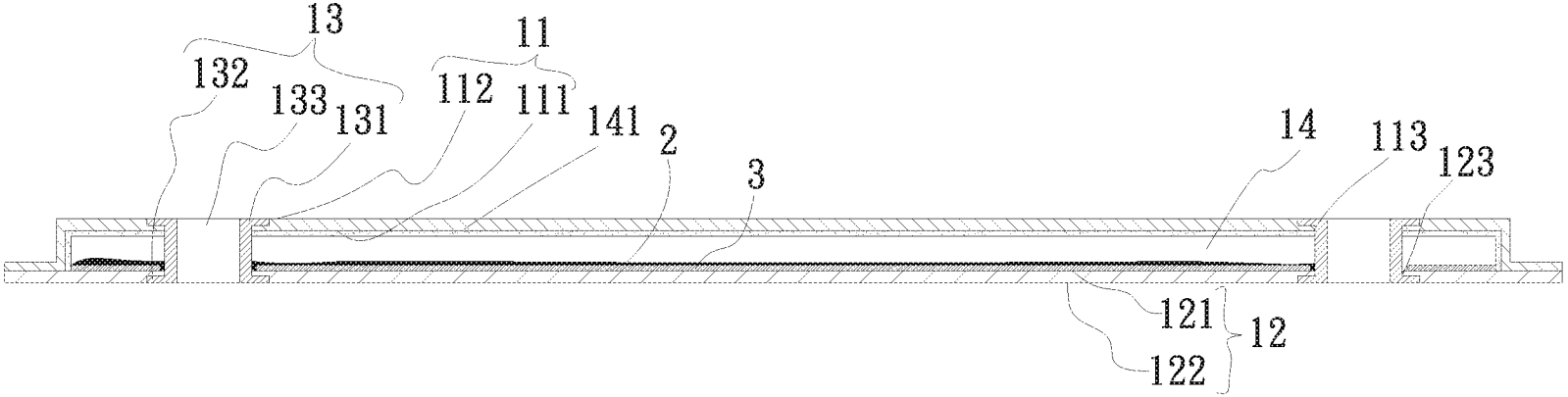
FIG. 4 is an assembled sectional view of the airtight penetration structure for heat dissipation device of FIG. 3.

Please refer to FIGS. 3 and 4, which are exploded perspective view and assembled sectional view, respectively, of an airtight penetration structure for heat dissipation device according to a first embodiment of the present invention. For the purpose of conciseness and clarity, the present invention is also briefly referred to as the airtight penetration structure and generally denoted by reference numeral 1 herein. As shown, the airtight penetration structure 1 in the first embodiment of the present invention includes a first plate member 11, a second plate member 12 and a plurality of hollow shaft members 13.

The first plate member 11 has a first side 111 and a second side 112, and is provided with a plurality of first fastening holes 113. The first fastening holes 113 respectively extend from the first side 111 to the second side 112 to penetrate the first plate member 11. In the present invention, the first and the second side 111, 112 are located at a lower and an upper side of the first plate member 11, respectively.

The second plate member 12 has a third side 121 and a fourth side 122, and is provided with a plurality of second fastening holes 123. The third and the fourth side 121, 122 are located at an upper and a lower side of the second plate member 12, respectively. The first and the second plate member 11, 12 are correspondingly closed to each other with the first side 111 facing toward the third side 121, such that the first and the second plate member 11, 12 together define a closed chamber 14 between them. The second fastening holes 123 respectively extend from the third side 121 to the fourth side 122 to penetrate the second plate member 12.

Each of the hollow shaft members 13 is provided at two free ends with a first flange 131 and a second flange 132, which are respectively radially outward extended from the two free ends to be perpendicular to the hollow shaft member 13. The hollow shaft members 13 are correspondingly extended through the first and the second fastening holes 113, 123 with the first and the second flanges 131, 132 attached to and flush with the second side 112 of the first plate member 11 and the fourth side 122 of the second plate member 12, respectively, to seal around the first and the second fastening holes 113, 123. Then, an airtight joint can be formed between each of the hollow shaft members 13 and any of the first and the second fastening holes 113, 123 on the first and the second plate member 11, 12 by way of welding or diffusion bonding or gluing. The hollow shaft members 13 respectively internally define an axial through bore 133 that extends from one of the two free ends to the other free end. The axial through bores 133 can be respectively provided with female threads (not shown), so that fastening elements with corresponding male threads can be screwed thereinto to tighten the heat dissipation device against a base board.

The first and the second plate member 11, 12 can be made of a copper material, an aluminum material, a stainless steel material, or a titanium material; and the first and the second plate member 11, 12 can be made of the same material or different materials.

As can be seen from FIG. 4, a hydrophilic layer 141 is provided on the first side 111 of the first plate member 11 at locations corresponding to the closed chamber 14. With the hydrophilic layer 141, the vapor-liquid circulation efficiency of a working fluid 2 filled in the closed chamber 14 can be increased.

Figure 5:
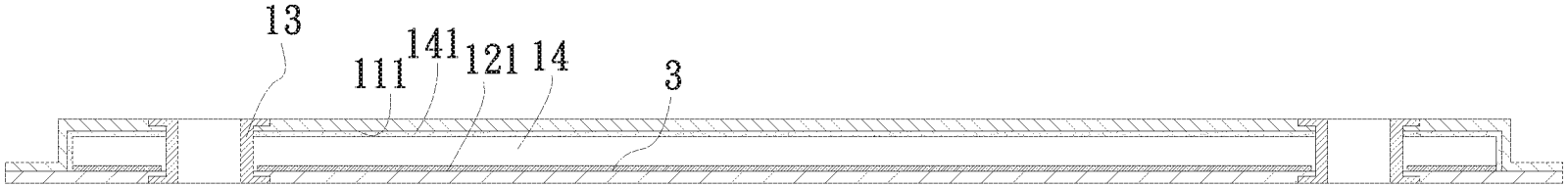
FIG. 5 is an assembled sectional view of an airtight penetration structure for heat dissipation device according to a second embodiment of the present invention.

FIG. 5 is an assembled sectional view of an airtight penetration structure for heat dissipation device according to a second embodiment of the present invention. As shown, the second embodiment is generally structurally similar to the first embodiment but it further includes a wick structure 3 provided in the closed chamber 14 on the third side 121 of the second plate member 12. It is noted the wick structure 3 is not in contact with any outer surface of the hollow shaft members 13. The wick structure 3 can be a mesh material, a fibrous material, or a porous structure. In the case the wick structure 3 is a porous structure, it can be formed or laminated on a part of the third side 121 by means of electrochemical deposition, electrocasting, 3D printing or printing. Since all other structural and functional features of the second embodiment are similar to those of the first embodiment, they are not repeatedly described herein.

When forming the porous structure by means of electrochemical deposition, the material used in the electrochemical deposition can be any one of a copper material, a nickel material, an aluminum material, and any other metal material with good thermal conductivity.

When forming the wick structure 3 using a mesh material, the mesh material can be made of one of a copper material, an aluminum material, a stainless steel material and a titanium material. Of course, the wick structure 3 can be otherwise formed by laminating two or more mesh materials together while the mesh materials are made of different ones of the above mentioned materials.

Figure 6:
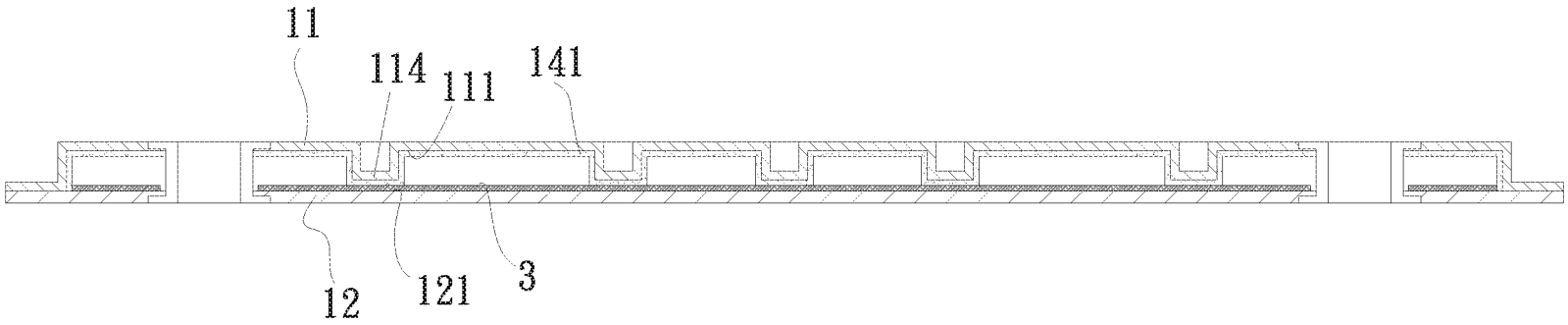
FIG. 6 is an assembled sectional view of an airtight penetration structure for heat dissipation device according to a third embodiment of the present invention.

FIG. 6 is an assembled sectional view of an airtight penetration structure for heat dissipation device according to a third embodiment of the present invention. As shown, the third embodiment is generally structurally similar to the second embodiment but it further includes a plurality of first protrusions 114 extended from the first side 111 of the first plate member 11 toward the third side 121 of the second plate member 12. The wick structure 3 is formed on the third side 121 with forward free ends of the first protrusions 114 in contact with a top surface of the wick structure 3. Locations on the second side 112 of the first plate member 11 corresponding to the first protrusions 114 are sunken from the second side 112. Since all other structural and functional features of the third embodiment are similar to those of the second embodiment, they are not repeatedly described herein.

Figure 7:
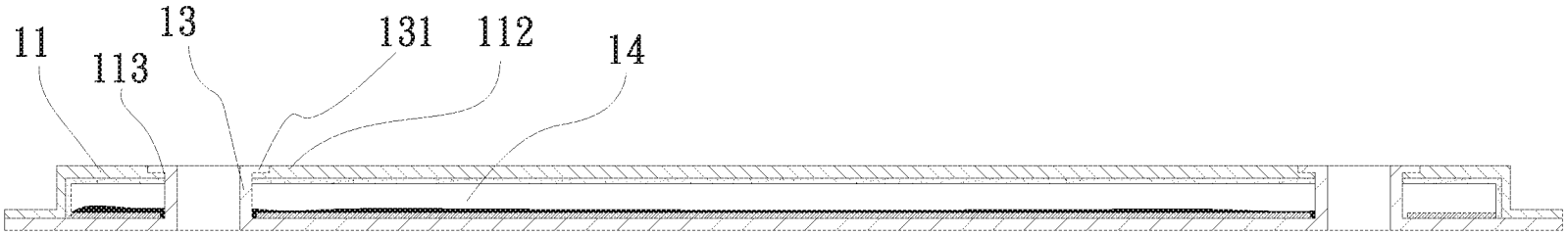
FIG. 7 is an assembled sectional view of an airtight penetration structure for heat dissipation device according to a fourth embodiment of the present invention.

FIG. 7 is an assembled sectional view of an airtight penetration structure for heat dissipation device according to a fourth embodiment of the present invention. As shown, the fourth embodiment is generally structurally similar to the first embodiment, except that each of the hollow shaft members 13 in the fourth embodiment is integrally formed with the second plate member 12 to extend from the third side 121 of the second plate member 12 toward the first side 111 of the first plate member 11. Further, each of the hollow shaft members 13 in the fourth embodiment is provided around a free end with a first flange 131, which is radially outward extended from the free end to be perpendicular to the hollow shaft member 13. In this embodiment, the first fastening holes 113 formed on the first plate member 11 are located corresponding to the hollow shaft members 13, allowing the hollow shaft members 13 to extend through the first fastening holes 113 and end at the second side 112 of the first plate member 11 with the first flanges 131 of the hollow shaft members 13 attached to and flush with the second side 112 to seal around the first fastening holes 113 and keep the closed chamber 14 airtight. Since all other structural and functional features of the fourth embodiment are similar to those of the first embodiment, they are not repeatedly described herein.

Figure 8:
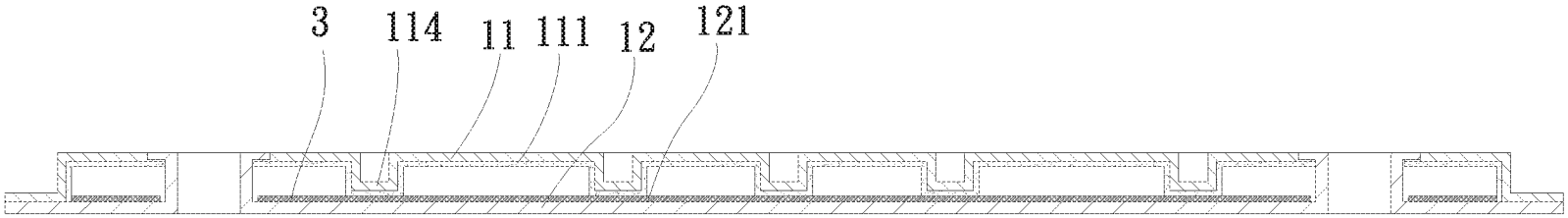
FIG. 8 is an assembled sectional view of an airtight penetration structure for heat dissipation device according to a fifth embodiment of the present invention.

FIG. 8 is an assembled sectional view of an airtight penetration structure for heat dissipation device according to a fifth embodiment of the present invention. As shown, the fifth embodiment is generally structurally similar to the fourth embodiment but it further includes a plurality of first protrusions 114 extended from the first side 111 of the first plate member 11 toward the third side 121 of the second plate member 12 and has a wick structure 3 formed on the third side 121. The first protrusions 114 are in contact with a top surface of the wick structure 3, and locations on the second side 112 of the first plate member 11 corresponding to the first protrusions 114 are sunken from the second side 112. Since all other structural and functional features of the fifth embodiment are similar to those of the fourth embodiment, they are not repeatedly described herein.

The primary object of the present invention is to provide an airtight penetration structure for a heat dissipation device, of which an internally defined vacuum-tight chamber has to be penetrated for extending fastening elements therethrough. With the airtight penetration structure of the present invention, it is able to maintain normal operation and gas-liquid circulation of the working fluid in the vacuum-tight heat dissipation device. Further, the provision of the hydrophilic layer and the wick structure in the airtight penetration structure of the present invention further enables upgraded gas-liquid circulation efficiency in the heat dissipation device.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An airtight penetration structure for a heat dissipation device, comprising:

a first plate member having a first side and a second side, and being provided with a plurality of first fastening holes; and the first fastening holes respectively extending from the first side to the second side to penetrate the first plate member;

a second plate member having a third side and a fourth side, and being provided with a plurality of second fastening holes; the second fastening holes respectively extending from the third side to the fourth side to penetrate the second plate member; and the first and the second plate member being closed to each other with the first side facing toward the third side, such that a closed chamber is defined between the first and the second plate member; and a plurality of hollow cylindrical shaft members respectively being provided at two opposed free ends with a first flange and a second flange, wherein the first and second flanges each extend radially outward, perpendicular to an axis of each hollow shaft member, and are similar in size and shape such that each hollow shaft member is radially and axially symmetrical; the hollow shaft members being correspondingly extended through the first and the second fastening holes with the first and the second flanges attached to and flush with the second side of the first plate member and the fourth side of the second plate member, respectively, to seal around the first and the second fastening holes.

2. The airtight penetration structure for heat dissipation device as claimed in claim 1, wherein each of the hollow shaft members internally defines an axial through bore that extends between the two free ends of the hollow shaft member.

3. The airtight penetration structure for heat dissipation device as claimed in claim 1, wherein the first side of the first plate member is provided with a hydrophilic layer.

4. The airtight penetration structure for heat dissipation device as claimed in claim 1, wherein the third side of the second plate member is provided with a wick structure.

5. The airtight penetration structure for heat dissipation device as claimed in claim 4, wherein the wick structure is selected from the group consisting of a mesh material, a fibrous material and a porous structure.

6. The airtight penetration structure for heat dissipation device as claimed in claim 5, wherein the mesh material is made of a material selected from the group consisting of a copper material, an aluminum material, a stainless steel material, and a titanium material.

7. The airtight penetration structure for heat dissipation device as claimed in claim 4, wherein the wick structure is formed by a way selected from the group consisting of electrochemical deposition, electrocasting, 3D printing and printing.

8. The airtight penetration structure for heat dissipation device as claimed in claim 7, wherein the electrochemical deposition is performed using a material selected from the group consisting of a copper material, a nickel material, and an aluminum material.

9. The airtight penetration structure for heat dissipation device as claimed in claim 4, wherein the wick structure is not in contact with the hollow shaft members.

10. The airtight penetration structure for heat dissipation device as claimed in claim 1, wherein the first and the second plate member are made of a material selected from the group consisting of a copper material, an aluminum material, a stainless steel material, and a titanium material.

11. The airtight penetration structure for heat dissipation device as claimed in claim 1, further comprising a plurality of first protrusions and a wick structure; the first protrusions being extended from the first side of the first plate member toward the third side of the second plate member; the wick structure being formed on the third side of the second plate member; the first protrusions respectively having a forward free end in contact with a top surface of the wick structure; and locations on the second side of the first plate member corresponding to the first protrusions being sunken from the second side.

12. An airtight penetration structure for a heat dissipation device, comprising:

a first plate member having a first side and a second side, and being provided with a plurality of first fastening holes; and the first fastening holes respectively extending from the first side to the second side to penetrate the first plate member; and a second plate member having a third side and a fourth side and having a plurality of hollow shaft members formed as a unibody with the second plate member; the first and the second plate member being closed to each other with the first side facing toward the third side, such that a closed chamber is defined between the first and the second plate member; the hollow shaft members respectively extending from the third side toward the first plate member to correspondingly extend through the first fastening holes on the first plate member; an end of each of the hollow shaft members extended through the first fastening hole being a free end, around which a first flange is provided; and the first flange being attached to and flush with the second side of the first plate member to seal around the first fastening holes.

13. The airtight penetration structure for heat dissipation device as claimed in claim 12, wherein each of the hollow shaft members internally defines an axial through bore that extends between two ends of the hollow shaft member; and the first flange of the hollow shaft member is radially outward extended from the free end to be perpendicular to the hollow shaft member.

14. The airtight penetration structure for heat dissipation device as claimed in claim 12, wherein the first side of the first plate member is provided with a hydrophilic layer.

15. The airtight penetration structure for heat dissipation device as claimed in claim 12, wherein the third side of the second plate member is provided with a wick structure.

16. The airtight penetration structure for heat dissipation device as claimed in claim 15, wherein the wick structure is selected from the group consisting of a mesh material, a fibrous material and a porous structure.

17. The airtight penetration structure for heat dissipation device as claimed in claim 16, wherein the mesh material is made of a material selected from the group consisting of a copper material, an aluminum material, a stainless steel material, and a titanium material.

18. The airtight penetration structure for heat dissipation device as claimed in claim 15, wherein the wick structure is formed by a way selected from the group consisting of electrochemical deposition, electrocasting, 3D printing and printing.

19. The airtight penetration structure for heat dissipation device as claimed in claim 18, wherein the electrochemical deposition is performed using a material selected from the group consisting of a copper material, a nickel material, and an aluminum material.

20. The airtight penetration structure for heat dissipation device as claimed in claim 15, wherein the wick structure is not in contact with the hollow shaft members.

21. The airtight penetration structure for heat dissipation device as claimed in claim 12, wherein the first and the second plate member are made of a material selected from the group consisting of a copper material, an aluminum material, a stainless steel material, and a titanium material.

* * * * *